United States Patent [19]

Ogi et al.

[11] 4,279,987

[45] Jul. 21, 1981

[54] LIGHT-SENSITIVE, DIRECT POSITIVE SILVER HALIDE PHOTOGRAPHIC MATERIAL

[75] Inventors: Keiji Ogi; Takashi Sasaki; Yasuo Tosaka, all of Hino, Japan

[73] Assignee: Konishiroku Photo Industry Co., Ltd., Tokyo, Japan

[21] Appl. No.: 93,734

[22] Filed: Nov. 13, 1979

[30] Foreign Application Priority Data

Nov. 14, 1978 [JP] Japan ..... 53/140136

[51] Int. Cl.[3] ..... G03C 5/24; G03C 1/485

[52] U.S. Cl. ..... 430/409; 430/564; 430/547

[58] Field of Search ..... 430/599, 566, 547, 598, 430/409–410, 564, 239

[56] References Cited

U.S. PATENT DOCUMENTS

| | | | |
|---|---|---|---|
| 2,497,875 | 2/1950 | Fallesen | 430/409 |
| 2,588,982 | 3/1952 | Ives | 430/410 |
| 2,592,250 | 4/1952 | Davey et al. | 430/547 |
| 2,983,606 | 5/1961 | Rogers | 430/239 |
| 3,227,552 | 1/1966 | Whitmore | 430/547 |
| 3,761,266 | 9/1973 | Milton | 430/410 |
| 3,761,276 | 9/1973 | Evans | 430/567 |
| 3,796,577 | 3/1974 | Collier et al. | 430/394 |

FOREIGN PATENT DOCUMENTS

| | | | |
|---|---|---|---|
| 1151363 | 5/1969 | United Kingdom | 430/409 |

*Primary Examiner*—Won H. Louie, Jr.

*Attorney, Agent, or Firm*—Finnegan, Henderson, Farabow, Garrett & Dunner

[57] ABSTRACT

This invention relates to a light-sensitive, direct positive silver halide photographic material, more particularly to a light-sensitive silver halide photographic material of internal latent image type containing a novel, development-accelerating compound, as used for the formation of a direct positive image by imagewise exposure followed by overall light-exposure before and/or during development or development treatment in the presence of a fogging agent.

11 Claims, No Drawings

LIGHT-SENSITIVE, DIRECT POSITIVE SILVER HALIDE PHOTOGRAPHIC MATERIAL

The present invention provides an art which can be applied also to color difusion transfer besides ordinary black-and-white photography and color photography. It is well known that a direct positive photographic image can be formed by using a light-sensitive silver halide photographic material but without requiring any intermediate treatment step or formation of a negative photographic image.

Known methods which have heretofore been employed in order to form a positive image by using a light-sensitive, direct positive type, silver halide photographic material can be classified, excepting specific ones, primarily into two types, in view of the practical usefulness.

According to one of the above two types, a silver halide emulsion which have previously been fogged is used and fog nucleus (latent image) at the exposed portion is destroyed by the utilization of solarization or Herschel effect to yield a positive image after development.

According to the another type, a silver halide emulsion of internal latent image type, which has not been fogged is used and, subsequent to imagewise exposure, surface development is effected after and/or during fog treatment to yield a positive image.

The above fog treatment may be effected by applying overall exposure to light, by using a fogging agent, by using a strong developing solution or by effecting heat treatment, but ordinarily a method comprising utilization of light or a fogging agent is adopted. Further, the silver halide photographic emulsion of internal latent image type means such silver halide photographic emulsion that possesses a sensitive speck primarily within the silver halide grains and forms a latent image within said the grains by exposure.

In comparison with the former type method, the latter type method is generally higher in the sensitivity and thus suitable for an application where high sensitivity is required. This invention relates in particular to this latter type method.

In the field of this art, a variety of arts have been known heretofore. Those which are principal can be seen in, for example, U.S. Pat. Nos. 2,592,250, 2,466,957, 2,497,875, 2,588,982, 3,761,266, 3,761,276 and 3,796,577 and British Patent No. 1,151,363.

According to these known processes, it is possible to prepare a light-sensitive photographic material having a relatively high sensitivity for a direct positive type.

With regard to a detail of the mechanism of forming a direct positive image, it cannot be said that definite explanation has been given but, for example, refering to "Internal-Image Desensitization" as discussed in "The Theory of the Photographic Process", by C. E. K. Mees and T. H. James third edition, page 161, the process of the formation of a positive image can be understood to certain degree.

Thus, it is considered that by virtue of the surface desensitization due to the so-called internal latent image which is formed within silver halide grains by the first imagewise exposure, fog nucleus is selectively formed only on the surface of unexposed silver halide grains and then a photographic image is formed in the unexposed portion by a surface development.

In order to selectively nucleate as above, there has been known to give uniform light-exposure over the whole surface or to use as the fogging agent a hydrazine compound or a heterocyclic quaternary nitrogen salt compound.

However, in the application of these methods where a direct positive image is formed by the use of light or a fogging agent to a variety of photographic fields, there are retained further technical problems which sould be improved.

For example, in such fog development, fogging by virtue of light or a fogging agent must be preceded in order to nucleate for inducing the development prior to the development reaction and consequently the induction period until the time when development is initiated is longer in comparison with the ordinary development of latent image silver, and as the result, the development rate is considerably delayed. Accordingly, when applied, in particular, to light-sensitive multi-layer color photographic material, these are caused such problems that unevenness in the sensitometry characteristics is liable to be caused between layers. Furthermore, the finally obtainable maximum density is relatively low.

As a method for increasing the maximum density in the color diffusion transfer process using a direct positive silver halide emulsion, use of a hydroquinone sulfonic acid derivative is described in U.S. Pat. No. 3,227,552.

However, in the case where such compound is used together, the following disadvantage has been found to be caused: When a positive image is formed by using the above-mentioned hydroquinone sulfonic acid derivative together with a fogging agent, it was found that the background portion was outstandingly discolored to blue and stained, although the maximum density of the image finally obtained was increased. Such staining not only damages the background portion of a photographic image but also particularly degrades the quality of color image when applied to color photography and consequently such problem becomes one which may be said disadvantageous.

An object of this invention is to provide an excellent light-sensitive silver halide photographic material of internal latent image type for use in the formation of a direct positive image, wherein the afore-mentioned problems in the prior art have been solved.

Another object of this invention is to provide a light-sensitive silver halide photographic material of internal latent image type for use in the formation of a direct positive image, wherein such light-sensitive silver halide photographic material of internal latent image type that is rapid in the proceeding the fogging development and free from stain, is used. More in detail, the object of this invention is to provide a light-sensitive silver halide photographic material of internal latent image type, which is developed after a shortened induction period, causes no stain in the background portion in the fogging development for a relatively short period of time and yields a good direct positive image wherein the maximum density is high and the minimum density is low.

Other objects of this invention will be apparent from later description of this specification.

As a result of extensive researches, the inventors found that the afore-mentioned objects could be achieved by means of a light-sensitive silver halide photographic material of internal latent image type for use in the formation of a direct positive image, containing a compound of the following general formula (said compound being referred to hereinafter simply as compound of this invention):

General formula

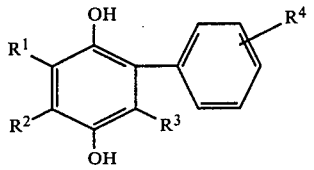

wherein $R^1$, $R^2$ and $R^3$ which may be the same or different represent independently a hydrogen or halogen atom or a substituted or unsubstituted alkyl or aryl group, $R^4$ represents a hydrogen or halogen atom or a substituted or unsubstituted alkyl, alkoxy, acyl, amino, aryl, aryloxy, nitro, hydroxy, carboxy or alkoxycarbonyl group.

In the above general formula, a halogen atom represented by $R^1$, $R^2$ or $R^3$ includes, for example, fluorine, chlorine, bromine or iodine; an alkyl group which may be straight or branched and preferably contains 1–18 carbon atoms includes, for example, methyl, ethyl, n-butyl, tert.-butyl, n-octyl, tert.-octyl, n-dodecyl, sec.-dodecyl, n-hexadecyl, sec.-octadecyl group, etc.; an alkoxy group includes, for example, methoxy, ethoxy, n-propoxy, n-butoxy, tert.-butoxy, n-hexoxy, n-dodecoxy, n-octadecoxy group, etc.; an acyl group includes, for example, acetyl, benzoyl, etc.; an aryl group includes, for example, phenyl group, etc.; and an aryloxy group includes, for example, phenoxy group, etc.

Further, each of the above groups may carry a substituent and such substituent includes, for example, a halogen atom, hydroxyl group, carboxyl group, alkyl group, alkoxy group or aryl group.

Among compounds of this invention, those of the general formula wherein $R^1$ and $R^3$ are hydrogen atoms, $R^2$ is a hydrogen atom or alkyl group (particularly one containing 1–5 carbon atoms), and $R^4$ is a hydrogen atom, an alkyl or alkoxy group containing 1–5 carbon atoms are further preferable. $R^4$ is more preferably connected at para position.

Concrete exemplification of a compound used in this invention will be given below without any intention of limiting the present invention thereto.

(1)

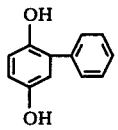

(2)

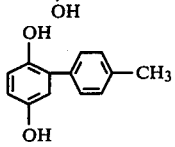

(3)

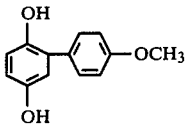

(4)

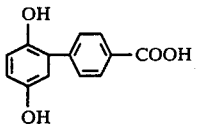

-continued (5)

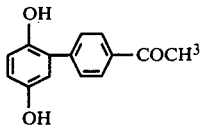

(6)

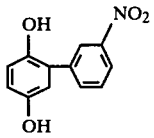

(7)

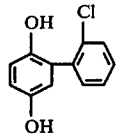

(8)

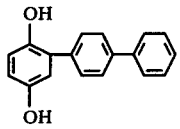

(9)

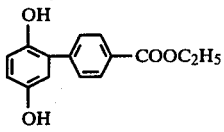

(10)

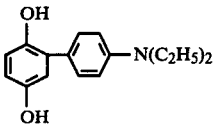

(11)

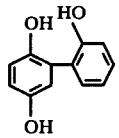

(12)

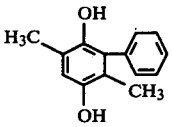

(13)

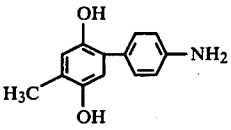

(14)

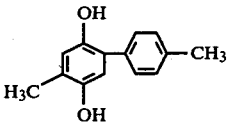

(15)

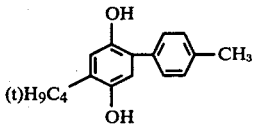

(16)

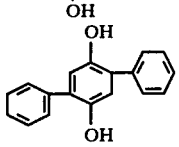

(17)

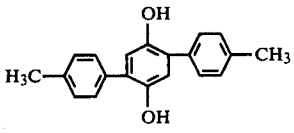

Of the compounds of this invention, a part thereof are available from the usual market and the others can readily by synthesized according to a process disclosed, for example, in Ber. B. 55, 3105 (1962) or J. Am. Chem. Soc. 56, 2478 (1934), etc.

A compound of this invention may be included in any layer constituting a light-sensitive silver halide photographic material of internal latent image type, preferably in the silver halide emulsion layer and/or at least one of the photographic constructive layers existing at the emulsion layer side on the support, more preferably in the silver halide emulsion layer and/or an adjacent layer thereto, and particularly preferably in the silver halide emulsion layer.

The content of a compound of this invention may be such amount that is satisfactory for accelerating the fogging development when development treatment is effected by subjecting the light-sensitive silver halide photographic material of internal latent image type to light-exposure or in the presence of a fogging agent. An amount to be actually added may vary over a broad range depending upon the characteristic features of the light-sensitive silver halide photographic material used or development condition. When a compound of this invention is included in the silver halide emulsion layer, an amount of 0.001–1 mol per mol of silver halide is preferable and particularly an amount of 0.001–0.5 mol is preferable. Further, when included in a layer adjacent to said silver halide emulsion layer, an amount to be added may be such as being in accordance with that to be added when the compound of this invention is included in the silver halide emulsion layer. Further, the time when the compound of this invention is added may be any suitable time after completion of ripening of the silver halide emulsion and before coating thereof, when included in said silver halide emulsion layer, or any suitable time from the preparation of coating liquid until coating is made, when included in a layer other than said silver halide emulsion layer.

A compound of this invention is added in the form of a solution in an appropriate solvent such as, for example, water, alcohols, acetone, benzene or dioxane.

Further, among compounds of this invention, those which are soluble in oil are in general preferably dissolved and dispersed in a high boiling solvent according to a process described in U.S. Pat. Nos. 2,322,027, 2,801,170, 2,801,171, 2,272,191 and 2,304,940, if necessary, by using together a low boiling solvent and then added to a hydrophilic colloidal solution. In this case, if necessary, an oleophilic photographic additive such as coupler may be dispersed together and included in a photographic constituent layer such as the silver halide emulsion layer, without causing any injurious effect.

Furthermore, a compound of this invention can readily be dispersed according to also a dispersion method using a latex solution as described in U.S. Pat. Nos. 2,269,158, 2,852,382, 2,772,168, 3,619,195 and 2,801,170.

Further, among compounds of this invention, those which are soluble in an alkali (or which are soluble in water) can also be added to the hydrophilic colloidal solution in the form of an alkaline solution (or an aqueous solution).

There has been well-known heretofore an attempt to improve the photographic function of a light-sensitive silver halide photographic material by including therein a substituted hydroquinone. For example, U.S. Pat. Nos. 2,983,606, 3,039,869 and 3,192,044 describe use of a phenyl hydroquinone as an auxiliary developing agent in the color diffusion transfer method. According to the description of the above U.S. patents, use of such auxiliary developing agent accelerates the development of silver halide and promotes unmovement of a dye developing agent in the exposed portion of a light-sensitive element. Although the inventions disclosed in the above U.S. patents are similar to the present invention with respect that the development is accelerated by the use of such auxiliary developing agent, they are quite different from the present invention in the object, constituent and effect thereof, because the prior inventions are concerned with a process for obtaining a color diffusion transfer image by using the dye developing agent and the silver halide emulsions used therein are an ordinary negative type silver halide emulsion which is so-called externally light-sensitive, thus forming a latent image principally on the surface of silver halide grains and consequently, in the light-sensitive element, a negative silver image is formed though finally a positive dye transfer image is obtained. To the contrary, the silver halide emulsion used in the present invention is as mentioned hereinbefore the internal latent image type silver halide emulsion and thus essentially distinguished from such ordinary negative type silver halide emulsion as forming a latent image on the surface of silver halide grains. Further, the light-sensitive material of this invention, which essentially accelerates formation of a fog nucleus inducing the development of silver halide in the process of this invention wherein a direct positive image can be obtained by the fogging development after imagewise exposure, can be applied broadly not only to the color diffusion transfer but also to the general black-and-white photography, color photography and the like. Thus, the present invention is quite distinguished from the prior arts as disclosed by the above U.S. patents in the technical idea thereof.

In the present invention, the principal step for forming a direct positive image comprises effecting the surface development after and/or during the fogging treatment applied, after the imagewise exposure, to an unfogged, light-sensitive silver halide photographic material of internal latent image type. Said fogging treatment can be carried out by subjecting to light-exposure or by using a fogging agent.

In the present invention, the exposure is carried out by dipping or wetting a light-sensitive material which has been subjected to the imagewise exposure in or with a developing solution or other aqueous solution and then subjecting said material to the uniform exposure overall to light. As the light source to be used for this, any light may be used so far as it is included within the wavelength range to which said light-sensitive material is susceptible. Alternatively a light of high intensity such as flash light may be applied for a short period of time or a weak light may be applied for a long period of time. The time during which the overall exposure is effected can be varied over a wide range depending upon a type of the light-sensitive material used, development condition or a type of light source used so that finally the best positive image can be obtained.

As the fogging agent to be used in the present invention, compounds over a broad range of type can be used and the fogging agent may be present at the time when the development is effected. Thus, the fogging agent may be included, for example, in the light-sensitive silver halide photographic material of internal latent image type such as silver halide emulsion layer or in the developing solution or in a processing solution used prior to the development treatment and conveniently in the light-sensitive silver halide photographic material (and especially in the silver halide emulsion layer). The amount of the fogging agent used can be varied over a wide range depending upon the objects and a preferable amount to be added is, when it is added to the silver halide emulsion layer, 1–1500 mg, particularly preferably 10–1000 mg per mol of silver halide. Further, when added to a solution such as developing solution, a preferable amount to be added is 0.01–5 g/liter, particularly 0.05–1 g/liter.

The fogging agent used in this invention includes, for example, hydrazines as described in U.S. Pat. Nos. 2,563,785 and 2,588,982; hydrazide or hydrazone compounds as described in U.S. Pat. No. 3,227,552; heterocyclic quaternary nitrogen salt compounds as described in U.S. Pat. Nos. 3,615,615, 3,718,470, 3,719,494, 3,734,738 and 3,759,901; and acylhydrazinophenylthioureas as described in U.S. Pat. No. 4,030,925. Further, these fogging agents can be used in combination. For example, Research Disclosure No. 15162 suggests the use of a combination of a non-adsorption type fogging agent and an adsorption type fogging agent.

Exemplification of useful fogging agent includes hydrazine compounds such as hydrazine hydrochloride, phenylhydrazine hydrochloride, 4-methyl-phenylhydrazine hydrochloride, p-methylsulfonamidethylphenylhydrazine, 1-formyl-2-phenylhydrazine, 1-acetyl-2-phenylhydrazine, 1-acetyl-2-(4-methylphenyl)hydrazine, 1-acetyl-2-(4-acetamidophenyl)-hydrazine, 1-methylsulfonyl-2-phenylhydrazine, 1-benzoyl-2-phenylhydrazine, 1-lauroyl-2-phenyl-hydrazine, 1-methylsulfonyl-2-(3-phenylsulfonamidophenyl)hydrazine, formaldehyde phenylhydrazine, acetone-4-methylphenylhydrazine, 1-sulfomethyl-2-phenylhydrazine, 1-sulfomethylamino-2-phenylhydrazine, etc.; N-substituted quaternary cycloammonium salts such as 3-(2-formylethyl)-2-methylbenzothiazolium bromide, 3-(2-acetylethyl)-2-ethylbenzothiazolium bromide, 3-(2-acetylethyl)-2-benzylbenzothiazolium bromide, 3-(2-formylethyl)-2-propylbenzo-thiazolium bromide, 5-chloro-3-(2-formylethyl)-2-methylbenzothiazolium bromide, 3-(2-acetylethyl)-2-benzylbenzoselenazolium bromide, 3-(2-acetylethyl)-2-benzyl-5-phenyl-benzoxazolium bromide, 2-methyl-3-[3-(phenylhydrazono)-propyl]benzothiazolium bromide, 2-methyl-3-[3-(p-tolylhydrazono)propyl]benzothiazolium bromide, 2-methyl-3-[3-(p-sulfophenylhydrazono)propyl]benzothiazolium bromide, 2-methyl-3-[3-(p-toluenesulfonylhydrazono)pentyl]-naphtho-[2,1-b]thiazolium iodate, 2-methyl-3-[3-(p-sulfophenylhydrazono)pentyl]benzothiazolium iodate, 1,2-dihydro-3-methyl-4-phenylpyrid[2,1-b]benzothiazolium bromide, 1,2-dihydro-3-methyl-4-phenylpyrid[2,1-b]-5-phenylbenzoxazolium bromide, 1,2-dihydro-3,4-dimethylpyrid[2,1-b]benzothiazolium bromide, 4,4'-ethylenebis(1,2-dihydro-3-methylpyrid[2,1-b]-benzothiazolium bromide), 1,2-dihydro-3-methyl-4-phenyl-pyrid[2,1-b]benzoselenazolium bromide, etc.; 5-[1-ethylnaphtho(1,2-b)thiazolin-2-ylidene ethylidene]-1-(2-phenylcarbazoyl)methyl-3-(4-sulfamoylphenyl)-2-thiohydantoin, 5-(3-ethyl-2-benzothiazolinilidene)-3-[4-(2-formylhydrazino)-phenyl]rhodanine, 1-[4-(2-formyl-hydrazino)-phenyl]-3-phenylthiourea and 1,3-bis[4-(2-formylhydrazino)phenyl]thiourea.

The light-sensitive silver halide photographic material of internal latent image type, containing a compound of this invention forms a direct positive image when it is subjected after the imagewise exposure to an overall light exposure or the development in the presence of a fogging agent. As the method of developing the light-sensitive silver halide photographic material according to this invention, any development method may be adopted and preferably the surface development is employed. This surface development method means the processing with a developing solution which is substantially free from any solvent for silver halide.

As the ordinary silver halide developing agent which can be used in the developing solution of this invention, there can be included polyhydroxybenzenes such as hydroquinone, aminophenols, 3-pyrazolidones, ascorbic acid and its derivatives, reductones, phenylenediamines or a mixture thereof. Specifically, there are included hydroquinone, aminophenol, N-methylaminophenol, 1-phenyl-3-pyrazolidone, 1-phenyl-4,4-dimethyl-3-pyrazolidone, 1-phenyl-4-methyl-4-hydroxymethyl-3-pyrazolidone, ascorbic acid, N,N-diethyl-p-phenylenediamine, diethylamio-o-toluidine, 4-amino-3-methyl-N-ethyl-N-(β-methanesulfonamidethyl)-aniline, 4-amino-3-methyl-N-ethyl-N-(β-hydroxyethyl)aniline, etc. These developing agents may previously be impregnated in the emulsion an then made to act on the silver halide during being dipped in an aqueous solution of high pH value.

The developing solution used in this invention is able to contain further a particular anti-fogging agent and development inhibitor, or alternatively these additives to the developing solution can optionally be incorporated into the layer of the light-sensitive silver halide photographic material. An anti-fogging agent which is ordinarily useful includes, for example, benzotriazoles such as 5-methylbenzotriazole, benzothiazoles such as 5-methylbenzothiazole; 1-phenyl-5-mercaptotetrazoles, heterocyclic thions such as 1-methyl-2-tetrazoline-5-thion; and aromatic and aliphatic mercapto compounds.

The light-sensitive silver halide photographic material of internal latent image type according to the present invention comprises at least one silver halide emulsion layer of internal latent image type.

The silver halide emulsion of internal latent image type according to the present invention is such emulsion that forms a latent image predominantly inside of the silver halide grains. In the emulsion, any silver halide, for example, silver bromide, silver chloride, silver chlorobromide, silver iodobromide or silver chloroiodobromide may be included.

Particularly preferably, the afore-mentioned emulsion is one which exhibits, when a part of the sample thereof coated on a transparent support is subjected to exposure with a light intensity scale for a fixed period of time up to about 1 second and then to the development with a surface developing solution A having the composition as given below, which contains substantially no solvent for silver halide and develops only an latent image formed on the surface of the grains, at 20° C. for 4 minutes, such maximum density that is not greater than one-fifth of the maximum density obtainable by subjecting another part of the same emulsion sample as above to the same exposure and to the development with an internal developing solution B having the composition as given below, which develops an latent image formed inside of the grains at 20° C. for 4 minutes. Preferably, the maximum density obtained by using the surface developing solution A is not greater than one-tenth of that obtained by using the internal developing solution B.

Surface Developing Solution A

Metol: 2.5 g
L-Ascorbic acid: 10 g
$NaBO_2 \cdot 4H_2O$: 35 g
KBr: 1 g
Water to make up: 1 liter Internal Developing Solution B Metol: 2.0 g
Sodium sulfite (anhydrous): 90.0 g
Hydroquinone: 8.0 g
Sodium carbonate monohydrate: 52.5 g
KBr: 5.0 g
KI: 0.5 g
Water to make up: 1 liter The silver halide emulsions of internal latent image type according to this invention includes those prepared by various processes. Such emulsions are, for example, the conversion type silver halide emulsion as described in U.S. Pat. No. 2,592,250, the silver halide emulsion containing silver halide grains which have been subjected to internal chemical sensitization as described in U.S. Pat. Nos. 3,206,316, 3,317,322 and 3,367,778, the silver halide emulsion containing silver halide grains in which a polyvalent metal ion is occluded as described in U.S. Pat. Nos. 3,271,157, 3,447,927 and 3,531,291, the silver halide emulsion in which the surface of silver halide grains containing a dopant has been weakly chemically sensitized as described in U.S. Pat. No. 3,761,276, the silver halide emulsion which has a layered grain structure as described in U.S. Pat. Nos. 3,935,014 and 3,957,488 or the silver halide emulsion containing silver iodide prepared according to the ammonia method as described in Japanese Patent Pre-Examination Publication NO. 52-156614.

Further, it is possible to include in the silver halide emulsion of internal latent image type according to the present invention a compound containing an azaindene ring and a nitrogen-containing heterocyclic compound containing mercapto group in an amount of 1 mg to 10 g per mol of the silver halide to give a more stable result which has a lower minimum density.

As the compound containing azaindene ring, 4-hydroxy-6-methyl-1,3,3a,7-tetrazaindene is preferable. As the nitrogen-containing heterocyclic compound containing mercapto group, a pyrazole ring, 1,2,4-triazole ring, 1,2,3-triazole ring, 1,3,4-thiadiazole ring, 1,2,3-thiadiazole ring, 1,2,4-thiadiazole ring, 1,2,5-thiadiazole ring, 1,2,3,4-tetrazole ring, pyridazine ring, 1,2,3-triazine ring, 1,2,4-triazine ring, 1,3,5-triazine ring, a ring formed by fusion of 2 or 3 rings of the above rings, for example, a triazolotriazole ring, diazaindene ring, triazaindene ring, tetrazaindene ring, pentazaindene ring, etc., phthalazinone ring and indazole ring are includeded, and one preferable is 1-phenyl-5-mercaptotetrazole.

Further, in the present invention, for example, mercury compounds, triazole series compounds, azaindene series compounds, benzothiazolium series compounds or zinc compounds can be used as the anti-fogging agent or stabilizing agent.

Furthermore, it is optionally effected to add various photographic additives to the silver halide emulsion of internal latent image type according to the present invention. For example, as the optical sensitizer usable in the present invention, there are included cyanines, merocyanines, 3- or 4-nuclear merocyanines, 3- or 4-nuclear cyanines, styryls, holopolacyanines, hemicyanines, oxonols and hemioxonols, and these optical sensitizers preferably contain as the nitrogen-containing heterocyclic nucleus the basic residue of thiazoline or thiazole, or the nucleus of rhodanine, thiohydantoin, oxazolidinedione, barbituric acid, thiobarbituric acid or pyrazolone. These nuclei may further be substituted by an alkyl, hydroxyalkyl, sulfoalkyl, carboxyalkyl, halogen, phenyl, cyano or alkoxy group and furthermore optionally condensed with a carbocyclic or heterocyclic ring.

The internal latent image type silver halide emulsion according to this invention can be supersensitized. Reference to the method of the supersensitization can be found, for example, in "Review of Supersensitization" (Photographic Science and Engineering) Vol. 18, page 4418 (1974).

Other additives used in this invention depending upon objects include, for example, a dihydroxyalkane as the wetting agent, a water-dispersible high molecular weight substance in the form of fine grain, which is obtained by emulsion polymerization of a copolymer of an alkyl acrylate or alkyl methacrylate and acrylic acid or methacrylic acid, styrenemaleic acid copolymer or styrene-maleic anhydride half alkyl ester copolymer suitable as the improver of physical properties of film and, for example, saponin, polyethylene glycol lauryl ether as the coating aid. Further, it is optionally effected to use as other photographic additives, a gelatin plasticizer, surfactant, UV-absorber, pH conditioner, antioxidant, antistatic agent, viscosity-increasing agent, granularity improver, dye, mordant, brightening agent, development modifier and matting agent.

The silver halide emulsion thus prepared is coated on a support, if necessary, through a subbing layer, antihalation layer or filter layer to give a light-sensitive silver halide photographic material of internal latent image type.

Use of the light-sensitive silver halide photographic material according to the present invention for color photography is useful and in this case, a cyan, magenta and yellow dye image forming couplers are preferably included in the silver halide photographic emulsion.

Said yellow dye image forming coupler includes those of benzoylacetanilide type, pivaloylacetanilide type of 2-equivalent type wherein the carbon atom at the position where the coupling takes place is substituted by a substituent which can be split off when the coupling reaction takes place (so-called a split off group), said magenta dye image forming coupler includes those of 5-pyrazolone series, pyrazolotriazole series, pyrazolinobenzimidazole series, indazolone series or 2-equivalent type containing the so-called split off group and said cyan dye image forming coupler includes those of phenol series, naphthol series, pyrazolquinazolone series or 2-equivalent type containing the split off group.

Further, in order to prevent fading of a dye image due to actinic light of short wavelength, use of a UV absorber, for example, thiazolidone, benzotriazole, acrylonitrile or benzophenone series compound is useful and, in particular, use of Tinuvin PS, ibid. 320, ibid. 326, ibid. 327 or ibid. 328 (all being products of Ciba-Geigy) alone or in combination with one another is convenient.

As the support for the light-sensitive silver halide photographic material according to the present invention, any one may be used and representative supports include polyethylene terephthalate film, polycarbonate film, polystyrene film, polypropylene film, cellulose acetate film, glass, baryta paper, polyethylene-coated paper, etc., if necessary, with subbing layer.

In the light-senesitive silver halide photographic material according to the present invention, an appropriate gelatin derivative can be included in addition to gelatin, depending upon object for which said material is used. Such appropriate gelatin derivative can include, for example, acylated gelatin, guanidylated gelatin, carbamylated gelatin, cyanoethanolated gelatin and esterified gelatin.

Further, in the present invention, other hydrophilic binder can be included depending upon objects and as appropriate binders are included, in addition to gelatin, a cellulose derivative such as cellulose acetate hydrolyzed up to 19–20% of the content of acetyl, polyacrylamide, etc. These binders can be added, depending upon objects, to a constructive layer of light-sensitive silver halide photographic material, such as emulsion layer, inter layer, protective layer, filter layer or back layer, and in the above-mentioned hydrophilic binder, an appropriate plastic agent or wetting agent can be included depending upon objects.

Furthermore, constituent layers of the light-sensitive silver halide photographic material can be hardened with any appropriate hardening agent. Such hardening agents include a chromium salt, zirconium salt and hardening agents of aldehyde series such as formaldehyde or mucohalogenic acid, halotriazine series, polyepoxy compound, ethyleneimine series, vinyl sulfon series and acryloyl series.

Moreover, in the light-sensitive silver halide photographic material according to the present invention, it is possible to apply on the support a number of various photographic constructive layers such as an emulsion layer, filter layer, inter layer, protective layer, sublayer, back layer, anti-halation layer, etc.

The light-sensitive silver halide photographic material according to the present invention can effectively be applied to various uses as for general black-and-white photography, X-ray photography, color photography, pseudocolor photography, printing photography, infrared photography, microphotography, silver dye-bleaching photography, and also to the colloid transfer method, silver salt diffusion transfer method and the color image transfer method, color diffusion transfer method, absorption transfer method, etc., as described in U.S. Pat. Nos. 3,087,817, 3,185,567 and 2,983,606 issued to Rogers, U.S. Pat. No. 3,253,915 issued to Weiyerts et al., U.S. Pat. No. 3,227,550 issued to Whitmore et al., U.S. Pat. No. 3,227,551 issued to Pearl et al., U.S. Pat. No. 3,227,552 issued to Whitmore, and U.S. Pat. Nos. 3,415,664, 3,415,645 and 3,415,646 issued to Land.

This invention will be exemplified in the following Examples but the embodiments of the present invention will not be limited by these Examples:

EXAMPLE 1

According to the method described in Example 1 of U.S. Pat. No. 2,592,250, a silver chloroiodobromide emulsion of internal latent image type based on the convertion mathod was prepared.

Compounds (1) and (2) of this invention were dissolved respectively in 5 ml of dibutyl phthalate (DBP) and 10 ml of ethyl acetate (EA) and then emulsified and dispersed in 100 ml of a 5% aqueous gelatin solution containing sodium dodecylbenzenesulfonate. Then, this emulsion dispersion solution was added to 1 liter of the above emulsion (containing 0.35 mol of silver chloroiodobromide). After further addition of 30 ml of a 4% aqueous solution of 2,4-dichloro-6-hydroxy-5-triazine sodium as the hardening agent, the resulting emulsion was coated on a cellulose triacetate support so that the amount of coated silver might be 35 mg/100 $cm^2$ and dried (Samples 2 and 3).

Separately, a sample in which no compound of this invention was added was prepared as a comparative sample in a similar manner (Sample 1).

These samples were subjected to exposure through an optical wedge for sensitometry by using an sensitometer (the exposure of this type referred to hereinafter as wedge exposure), developed with a developing solution having the following formulation at 20° C. for 6 minutes, and fixed, washed with water and dried in an ordinary manner:

Metol: 2.5 g
1-Ascorbic acid: 10 g
$NaBO_2 \cdot 2H_2O$: 35 g
KBr: 1 g
Water to make up: 1 liter However, until completion of the above development from 30 seconds after the initiation of the development, the whole serface was subjected to uniform exposure with 5 lux-light. Results of the positive images thus obtained are shown in Table 1.

TABLE 1

| Sample No. | Compound added and its Amount (g) | | Maximum Density | Minimum Density |
|---|---|---|---|---|
| 1 (Control) | None, | 0 | 0.91 | 0.08 |
| 2 | Compound (1), | 2 | 1.21 | 0.08 |
| 3 | Compound (2), | 2 | 1.43 | 0.08 |

From the results shown in Table 1, it is noted that, in comparison with the Comparative Sample 1, Samples 2 and 3 which contain the compounds of this invention yield good positive images wherein the maximum density is higher.

EXAMPLE 2

After the wedge exposure using Examples 1 to 3 as prepared in Example 1, development with a developing solution having the following formulation was effected at 20° C. for 1 minute, 3 minutes and 4 minutes, and then fixing, washing with water and drying were effected:

Phenidone: 0.4 g
Sodium sulfite (anhydrous): 75 g
Hydroquinone: 10 g
Sodium carbonate (monohydrate): 40 g
Potassium bromide: 4 g
5-Methylbenzotriazole: 10 mg
1-Formyl-2-phenyl-hydrazine (fogging agent): 1 g
Water to make up: 1 liter
(pH Being adjusted to 12.5 with sodium hydroxide.)

Results of the positive images thus obtained are shown in Table 2.

TABLE 2

| Sample No. | Development Time (min.) | Maximum Density | Minimum Density |
|---|---|---|---|
| 1 (Control) | 1 | 0.29 | 0.06 |
| | 3 | 0.47 | 0.09 |
| | 4 | 0.60 | 0.11 |
| 2 | 1 | 0.54 | 0.06 |
| | 3 | 0.81 | 0.09 |
| | 4 | 0.97 | 0.11 |

TABLE 2-continued

| Sample No. | Development Time (min.) | Maximum Density | Minimum Density |
|---|---|---|---|
| 3 | 1 | 0.80 | 0.07 |
| | 3 | 0.99 | 0.09 |
| | 4 | 1.25 | 0.01 |

From the results shown in the above Table 2, it is noted that even when development using a fogging agent is effected, there are formed more rapidly by the compounds of this invention good positive images wherein the maximum density is outstandingly increased by virtue of accelerated fogging development and the minimum density is low.

EXAMPLE 3

A solution of 39 g of 1-(2,4,6-trichlorophenyl)-3-(2-chloro-5-octadecylsuccinimidanilino)-5-pyrazolone as the magenta coupler and the compounds of this invention as specified in Table 3, respectively, dissolved in 39 ml of DBP and 75 ml of EA was added respectively to 500 ml of a 5% aqueous gelatin solution containing sodium dodecylbenzenesulfonate, and emulsified and dispersed.

Then, each of the resulting emulsion dispersion solutions was added to 1 liter of the same silver halide emulsion of internal latent image type (containing 0.35 mol of silver chloroiodobromide) as used in Example 1 and mixed. Then, 25 ml of a 5% acetone solution of tetrakis(vinylsulfonylmethyl)methane serving as the hardening agent was added. The resulting emulsion was coated on a cellulose triacetate support so that the amount of coated silver might be 20 mg/100 $cm^2$ and then dried (Sample 5 to 8).

Separately, a sample in which no compound of this invention was added was prepared as a Comparative Sample in a similar manner (Sample 4).

After being subjected to the wedge exposure, these samples were developed at 20° C. for 5 minutes with a developing solution having the following formulation:

4-Amino-3-methyl-N-ethyl-N-(β-methanesulfonamidethyl)-aniline sulfate: 5 g
Sodium sulfite (anhydrous): 2 g
Sodium carbonate (monohydrate): 15 g
Potassium bromide: 1 g
Benzyl alcohol: 10 ml
Water to make up: 1 liter However, for 3 minutes after 30 seconds from the initiation of the above development, the whole surface was subjected to uniform exposure with 1 lux-light. Subsequently, ordinary bleaching, fixing, wasing with water and drying were effected.

Results of positive images obtained by each of the above samples are given in Table 3.

TABLE 3

| Sample No. | Compound added and its Amount (g/liter of emulsion) | | Maximum Density | Minimum Density |
|---|---|---|---|---|
| 4 (control) | None, | 0 | 1.20 | 0.18 |
| 5 | Compound (1), | 2 | 2.18 | 0.11 |
| 6 | Compound (2), | 2 | 2.39 | 0.10 |
| 7 | Compound (3), | 2 | 2.23 | 0.11 |
| 8 | Compound (14), | 2 | 2.30 | 0.10 |

As apparent from the above results, it is noted that by inclusion of the compounds of this invention, there are obtainable good color positive image in which the maximum density is high and the minimum density is low.

EXAMPLE 4

Samples 4 to 8 as prepared in Example 3 and a sample wherein potassium 2-octadecylhydroquinone-5-sulfonate (Compound A) described in U.S. Pat. No. 3,227,552 was added in place of the compound of this invention (Sample 9) were prepared in a similar manner.

These samples were subjected to wedge exposure and thereafter developed at 20° C. for 5 minutes with a developing solution having the following formulation:

4-Amino-3-methyl-N-ethyl-N-(β-methanesulfonamidethyl)-aniline sulfate: 5 g
Sodium sulfite (anhydrous): 2 g
Trisodium phosphate: 40 g
Benzimidazole: 50 mg
1-Acetyl-2-phenylhydrazine (fogging agent): 1 g
Water to make up: 1 liter
(pH Being adjusted to 12.0 with sodium hydroxide.)

Then, bleaching, fixing and washing with water were affected in an ordenary manner.

Results of a positive image obtained with each of the above samples are shown in Table 4. As apparent from these results, the samples containing the compounds of this invention (Samples 5 to 8) where the fogging development is accelerated are increased in the maximum density, and from the comparison in blue stain density within the minimum density range, it is noted that good positive images in which no stain is caused and the maximum density is higher are obtainable by the above samples, in comparison with the Sample 9 that contains the known compound A.

TABLE 4

| Sample No. | Compound added and its Amount (g/liter of emulsion) | | Maximum Density | Minimum Density | Blue Stain Density |
|---|---|---|---|---|---|
| 4 (Control) | None, | 0 | 1.26 | 0.15 | 0.00 |
| 5 | Compound (1), | 2 | 2.41 | 0.10 | 0.00 |
| 6 | Compound (2), | 2 | 2.62 | 0.10 | 0.00 |
| 7 | Compound (3), | 2 | 2.48 | 0.10 | 0.00 |
| 8 | Compound (14), | 2 | 2.50 | 0.10 | 0.00 |
| 9 (Comparative Sample) | Compound A, | 2 | 2.33 | 0.10 | 0.23 |

EXAMPLE 5

On a transparent polyethylene terephthalate support, the following layers were coated successively to form a light-sensitive element (Sample 11):

(1) Image receiving layer containing a 1:1 copolymer of styrene and N-vinylbenzyl-N,N,N-trihexylammonium chloride (22 mg/100 $cm^2$) and gelatin (22 mg/100 $cm^2$),
(2) Light reflecting layer containing titanium dioxide (220 mg/100 $cm^2$) and gelatin (22 mg/100 $cm^2$),
(3) Opaque layer containing carbon black (28 mg/100 $cm^2$) and gelatin (18 mg/100 $cm^2$),
(4) Layer containing magenta image dye-releasing compound, 1-hydroxy-4-[3-{α-(2-(2-methoxy-5-sulfamoyl-1-azo)-4-hydroxy-1-naphthoxy)ethylcarbamoyl}-phenylsulfonamido]-N-(δ-2,4-di-tert.-amylphenoxybutylyl)-2-naphthamide (17 mg/100 $cm^2$), N,N-diethyllaurylamide (11 mg/100 $cm^2$) and gelatin (25 mg/100 $cm^2$), (5) Light-sensitive emulsion layer containing the same internal latent image type silver chloroiodobromide emulsion as used in Example 1 (14 mg/100 $cm^2$ calculated in terms of silver), the compound (2) of this invention (1 mg/100 $cm^2$), DBP (2 mg/100 $cm^2$), 1-formyl-2-phenylhydrazine (0.13 mg/100 $cm^2$) and gelatin (16.5 mg/100 $cm^2$), and (6) Protective layer containing mucochloric acid (1.0 mg/100 $cm^2$) and gelatin (10.0 mg/100 $cm^2$).

Further, for comparison, a sample in which no compound of this invention is contained in the light-sensitive layer (5) was prepared in a similar manner (Sample 10).

Then, on a transparent polyethylene terephthalate film support of 100 μm of thickness, the following layers were coated successively to prepare a cover sheet:

(1) Neutralization layer of 22.0 μm of dry film thickness containing a 75/25% by weight of copolymer of acrylic acid and ethyl acrylate (220 mg/100 $cm^2$) and (2) Timing layer of 5.0 μm in thickness containing cellulose diacetate (acetylation degree 40%) (50 mg/100 $cm^2$).

Thereafter, the above-mentioned light-sensitive element was subjected to wedge exposure and the above cover sheet was superposed and a pod of about 1.0 ml content, which contained a processing composition as given below was attached between said light-sensitive element and the cover sheet to form a film unit. Then, the film unit thus obtained was passed through between a pair of pressure rollers juxtaposed at the distance of about 340 μm to burst said pods and to spread the contents thereof between the light-sensitive element and cover sheet.

The composition of the above processing solution was as follows:

Potassium hydroxide: 56 g
Sodium sulfite: 2.0 g
4-Hydroxymethyl-4-methyl-1-phenyl-3-pyrazolidone: 8.0 g
5-Methylbenzotriazole: 2.8 g
Carbon black (Raven-450: manufactured by Columbia Carbon): 150 g
Carboxy methyl cellulose sodium salt (High Viscosity Type: manufactured by Tokyo Kasei): B 50.0 g
Benzyl alcohol: 1.5 ml
Distilled water to make up 1000.0 ml After 3 minutes, a dye image was observed through the transparent support of the light-sensitive element.

Results of the magenta dye image thus obtained are shown in Table 5.

TABLE 5

| Sample No. | Maximum Density | Minimum Density |
|---|---|---|
| 10 (Control) | 1.43 | 0.22 |
| 11 | 2.57 | 0.20 |

From the above results, it is noted that a good diffusion transfer positive image having high maximum density and low minimum density can be formed by using a compound of this invention.

What we claim is:

1. A direct positive photographic material comprising a light-sensitive internal latent image type silver halide emulsion layer coated on a support, characterized by containing a compound of the general formula

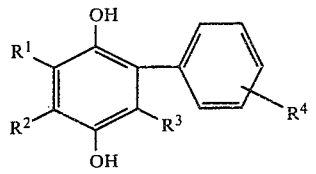

wherein $R^1$, $R^2$ and $R^3$ which may be the same or different represent independently a hydrogen or halogen atom or a substituted or unsubstituted alkyl or aryl group, $R^4$ represents a hydrogen or halogen atom or a substituted or unsubstituted alkyl, alkoxy, acyl, amino, aryl, aryloxy, nitro, hydroxy, carboxy or alkoxycarbonyl group.

2. A direct positive photographic material according to claim 1 wherein $R^1$, $R^2$ and $R^3$ represent hydrogen atoms.

3. A direct positive photographic material according to claim 1 wherein $R^1$ and $R^2$ individually represent a hydrogen atom or a lower alkyl group having a carbon atom number 1 to 4.

4. A direct positive photographic material according to claim 1 wherein $R^4$ represents a hydrogen atom or an alkyl or alkoxy group.

5. A direct positive photographic material according to claim 4 wherein $R^4$ is connected at a para position.

6. A direct positive photographic material according to claim 1 wherein the compound is represented by following formula;

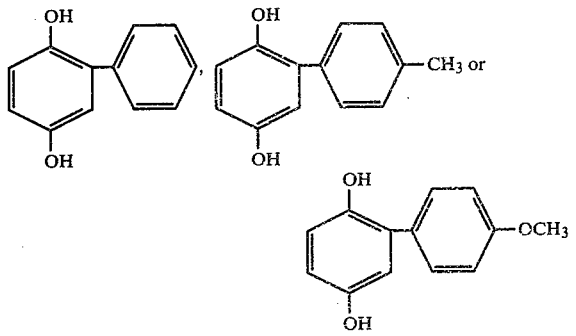

7. A direct positive photographic material according to claim 1 wherein the compound is included in a light-sensitive internal latent image type silver halide emulsion layer.

8. A direct positive photographic material according to claim 7 wherein an amount of the compound is 0.001–1 mol per mol of silver halide.

9. A direct positive photographic material according to claim 1 wherein the compound is included in a layer adjacent to the light-sensitive internal latent image type silver halide emulsion layer.

10. A direct positive photographic material according to claim 1, wherein the material comtains a cyan, magenta and yellow dye forming couplers.

11. A process for forming a direct positive image comprising the steps of:

(a) imagewise exposing a photographic material comprising a light-sensitive internal latent image type silver halide emulsion layer coated on a support; and (b) (i) overall light-exposing said photographic material before and/or during development or (ii) developing said photographic material in the presence of a fogging agent, wherein said photographic material contains a compound of the general formula

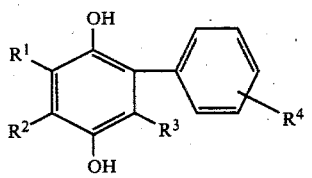

wherein $R^1$, $R^2$, and $R^3$ which may be the same or different and represent independently a hydrogen or halogen atom or a substituted or unsubstituted alkyl or aryl group, $R^4$ represents a hydrogen or halogen atom or a substituted or unsubstituted alkyl, alkoxy, acyl, amino, aryl, aryloxy, nitro, hydroxy, carboxy or alkoxycarbonyl group.

* * * * *